United States Patent [19]

Benford et al.

[11] Patent Number: 5,045,350

[45] Date of Patent: Sep. 3, 1991

[54] APPLYING TENSION TO LIGHT GAGE GRAIN-ORIENTED SILICON ELECTRICAL STEEL OF LESS THAN 7-MIL BY STRESS COATING TO REDUCE CORE LOSSES.

[75] Inventors: James G. Benford; Edward Choby, Jr., both of Pittsburgh, Pa.

[73] Assignee: Allegheny Ludlum Corporation, Pittsburgh, Pa.

[21] Appl. No.: 418,607

[22] Filed: Oct. 10, 1989

[51] Int. Cl.[5] ..... B05D 5/12; H01F 1/04

[52] U.S. Cl. ..... 427/127; 427/318; 427/444; 148/113; 148/122

[58] Field of Search ..... 148/122, 113; 427/318, 427/319, 127, 444

[56] References Cited

U.S. PATENT DOCUMENTS

| | | | |
|---|---|---|---|
| 2,453,429 | 11/1944 | Gorman, Sr. | 427/444 |
| 4,032,366 | 6/1977 | Choby, Jr. | 148/113 |
| 4,269,634 | 5/1981 | Foster et al. | 148/113 |
| 4,608,100 | 8/1986 | Malagari, Jr. | 148/112 |
| 4,713,123 | 12/1987 | Inokuti et al. | 427/127 |
| 4,948,433 | 8/1990 | Nakashima et al. | 148/113 |
| 4,979,996 | 12/1990 | Kobayashi et al. | 148/111 |

*Primary Examiner*—Michael Lusigna
*Assistant Examiner*—Diana L. Dudash
*Attorney, Agent, or Firm*—Patrick J. Viccaro

[57] ABSTRACT

A method is provided to reduce the core loss measured at frequencies of 60 Hz or higher in light-gauge, grain-oriented, silicon steel sheet or strip of less than 7 mil thickness and conventional permeability of $\mu 10 < 1850$ at 60 Hz, the method includes coating such steel with tension-inducing stress coatings in order to exert tensile stresses on the silicon steel of at least approximately 600 psi and further provides a method with the step of preparing the surfaces of the light-gage, grain-oriented, silicon steel products to support the stresses of the applied tension-inducing stress coatings in order to prevent spalling of the coatings.

6 Claims, No Drawings

APPLYING TENSION TO LIGHT GAGE GRAIN-ORIENTED SILICON ELECTRICAL STEEL OF LESS THAN 7-MIL BY STRESS COATING TO REDUCE CORE LOSSES.

BACKGROUND OF THE INVENTION

1. Field of the Invention

The present invention generally relates to methods for treating electrical steel strips or sheets and, more particularly, to a method for reducing core losses in light-gage grain-oriented silicon steels involving coating such steels with a stress coating to induce tension stresses therein.

2. Description of the Prior Art

In alternating current equipment and machines, such as magnetic core materials in motors, the use of plain carbon steel may cause the electrical losses to be unduly high. The 1 percent to 4 percent silicon in electrical steels, when used as a replacement for the plain carbon steels, serves to materially lessen the electrical losses which would otherwise occur, and silicon-irons are relatively inexpensive alloy steels.

These silicon steels permit the necessary alternations of the magnetic field without undue energy losses because they possess increased electrical resistance, which diminishes that part of the loss due to eddy currents. Also, while the plain carbon steels may gradually become even worse electrically with time during service, it is found that the silicon steels show relatively little of such an aging effect.

Silicon steels produced in sheet and strip form for electrical use and containing up to approximately five percent silicon, this being the upper limit for commercial materials since brittleness or lack of ductility increases as the percentage of silicon increases, are generally referred to as electrical sheets and strip. "Core loss" is the magnetic property commonly used for grading electrical sheets and strip. Core loss may be defined as that amount of electrical energy converted to heat and dissipated uselessly when magnetic structures are magnetized with alternating current. The lower the core loss of the material, the better is its magnetic quality.

The various commercial grades of electrical sheet and strip are generally sold on the basis of a specified maximum core loss at an induction of either 10 or 15 kilogausses (KG). Core loss values are generally expressed as watts per pound (wpp) at 60 Hz or other frequencies and vary for each grade and thickness of steel since the thickness or gage of a sheet affects the magnetic properties of a given grade of steel.

The beneficial effects on core loss provided by stress coatings on grain-oriented silicon steels of conventional thickness (7 mils or thicker) with $\mu 10$ levels in excess of 1850 at 50 or 60 Hz are well known in the art ($\mu 10$ indicating magnetic permeability in an applied field of 10 Oersteds). It is generally accepted that a favorable response to tension on the order of 5% to 10% reduction in core loss is reserved only for steels with $\mu 10$ levels in excess of 1850 and more commonly in excess of 1880. Such coatings have become a commercial reality since the advent of high-permeability steels in the last 15 years because of the significant beneficial core loss reductions experienced by such steels under tension. Furthermore, such beneficial effects from stress coatings are not known for light-gage (less than 7 mils) conventional grain-oriented silicon steels of relatively poorer $\mu 10$ at test frequencies above 60 Hz and, particularly, at 400 Hz, which is a frequency oftentimes used in the testing and application of such light-gage steels.

It is therefore an object of the invention to apply tension-inducing stress coatings to light-gage grain-oriented silicon steels to reduce the maximum core loss thereof.

It is a further object of the invention to a apply tension inducing stress coatings to grain-oriented silicon steels having low $\mu 10$ levels to reduce the maximum core loss thereof.

It is a further object of the invention to provide a method for preparing the surfaces of light-gauge grain-oriented silicon steel products to support the stresses of applied tension-inducing stress coatings in order to prevent spalling of the coatings.

Still other objects and advantages will become apparent in light of the description of the invention presented hereinbelow.

SUMMARY OF THE INVENTION

In order to produce beneficial core loss effects (i.e. reduced maximum core loss) in light-gauge, grain-oriented, silicon steel sheet or strip of less than 7 mil thickness having $\mu 10$ of less than 1850, the present invention proposes coating such steel with tension inducing stress coatings in order to exert tensile stresses in the silicon steel of at least approximately 600 psi. The invention further provides a method for preparing the surfaces of the light-gage, grain-oriented, silicon steel products to support the stresses of the applied tension inducing stress coatings in order to prevent spalling of the coatings.

DESCRIPTION OF THE PREFERRED EMBODIMENTS

The method of the present invention is suited for using 2-, 4-, and 6-mil thick silicon steel in the cold rolled condition as starting materials. These gages are produced by either direct rolling of the silicon steel to the desired light-gage thickness upon manufacture, or subsequent rerolling of prefabricated silicon steel from a standard gage, i.e. 7 mils or greater, down to the desired gage.

Such light-gage steels, when coated according to the method of the present invention, experienced significant reductions in core loss at 60 Hz and 400 Hz in the presence of tensile stress. The magnitudes of the core loss reductions were unexpected since they were traditionally thought to be available only in steels with relatively good grain orientation as indicated by $\mu 10$. Relatively good orientations are defined as $\mu 10 > 1850$ and preferably $\mu 10 > 1880$, and the subject steels typically have $\mu 10 < 1830$.

Preparation and coating of the 2-, 4-, and 6-mil silicon steel samples may be practiced according to known processes for coating conventional thickness strip or sheet steels. For the examples herein, the samples were prepared according to the steps outlined as follows:

The residual rolling oil present on the steel samples was burned off by heating the steel in the presence of oxygen in an oxidizing atmosphere, such as in air to 1475° F. for a few seconds. The steel was then passed through an acid solution, such as a 25% phosphoric acid solution for 10 to 15 seconds to remove surface oxides produced in the aforementioned burnoff. Following this, the steel was rinsed and dried. Finish coatings comprising either a conventional phosphate insulating coating or a tension inducing stress coating were then applied to the samples. The coated samples were then heated to 1550° F. for 3 to 25 seconds to recrystallize the steel and cure the coatings.

Samples of the 2-, 4-, and 6-mil silicon strip steels coated with the tension inducing stress coating were then compared for core loss reductions at 60 Hz and 400 Hz at 15KG with identical samples coated with a conventional phosphate insulating coating and with identical uncoated samples. The conventional phosphate insulating coating in the comparison is used by the Allegheny Ludlum Corporation under the designation number C-10 and is a standard insulating coating containing chromic acid and monomagnesium phosphate. The tension inducing stress coating in the comparison is also used by the Allegheny Ludlum Corporation under the designation number C-10S. In addition to chromic acid and monomagnesium phosphate, this coating contains colloidal silica. Similar coatings based upon monoaluminum phosphate or other metal phosphates as known in the art, rather than monomagnesium phosphate, may be employed as well. The conventional C-10 coating exerts some stress on the steel but the stress exerted thereby is not comparable to nor is it intended to be comparable to the stress exerted by the C-10S coating which is specifically formulated to induce tensile stresses in the steel. The stress exerted by the C-10S coating is typically on the order of 1000 psi or greater depending on the thicknesses of the coating and the steel being coated.

Results of the comparisons between the uncoated, conventionally coated (C-10), and stress coated (C-10S) 6-, 4-, and 2-mil oriented silicon steel samples each under no mechanically-induced tension and each under 1000 psi mechanically induced tension (in the rolling direction of the steel) are illustrated in Examples 1, 2 and 3, respectively, presented hereinbelow.

EXAMPLE 1

A group of three 6-mil Epstein packs was treated as described above up to the coating step. One of the packs was then left uncoated, a second of the packs was coated with conventional C-10 coating and a third of the packs was coated with stress inducing C-10S coating prior to the recrystallizing and curing treatment. The uncoated sample was included to serve only as a basis of reference. Such a bare steel would not find commercial application because of its high propensity for rusting.

Then, as is customary in commercial practice for grading purposes, the Epstein packs were given a stress relief anneal of two hours at 1475° F. in an 85% $N_2$ - 15% $H_2$ atmosphere. The measured magnetic properties of each of the three packs after annealing were as follows:

| Coating | μ10 (60 Hz) | 15 KG Core Loss* (Watts per Pound) 60 Hz | 400 Hz |
|---|---|---|---|
| Uncoated | 1782 | 0.744 | 7.940 |
| C10 | 1766 | 0.620 | 7.367 |
| | | (−17) | (−7) |
| C-10S | 1764 | 0.546 | 6.914 |
| | | (−27) | (−13) |

*(Numbers in parentheses = % change from uncoated sample)

As can be seen, the C-10 coating provided a 7% improvement over the uncoated sample in the 400 Hz core loss which is the principal frequency of interest for these light gauge materials. This improvement has significance only in that it indicates that in addition to providing insulation and rust resistance, the standard C-10 coating also benefits the core loss, to some degree. The C-10S sample provided a 13% improvement in core loss over the uncoated sample at 400 Hz and was some 6% better than the standard coating at 400 Hz. The benefits of the C-10S coating over the C-10 coating were even larger for the 60 Hz core losses.

Selected strips were then extracted from each Epstein pack and subjected to tests either with or without mechanically applied tension to determine to what degree the coatings were attaining the full core loss benefits which were achievable by mechanically applied tensioning. The single strip magnetic results were as follows:

| Coating | Mechanically Applied Tension (psi) | Applied Coating Thickness (mils) | μ10 (60 Hz) | 15 KG Core Loss* (Watts per Pound) 60 Hz | 400 Hz |
|---|---|---|---|---|---|
| Uncoated | 0 | 0 | 1782 | 0.744 | 7.940 |
| Uncoated | 1000 | 0 | 1789 | 0.499 | 6.482 |
| | | | | (−33) | (−18) |
| C-10 | 0 | .055 | 1766 | 0.620 | 7.367 |
| C-10 | 1000 | 0.055 | 1772 | 0.497 | 6.436 |
| | | | | (−20) | (−13) |
| C-10S | 0 | 0.051 | 1764 | 0.546 | 6.914 |
| C-10S | 1000 | 0.051 | 1769 | 0.498 | 6.440 |
| | | | | (−9) | (−7) |

*(Number in parentheses = % change from unstressed sample)

The change in core loss exhibited by the uncoated 6-mil steel under 1000 psi tension is perhaps the maximum theoretical change that could be expected for the 6-mil sample under pure tension. In other words, the value of the core loss achieved under that tension in the uncoated 6-mil steel may be the minimum core loss level that can be expected. It appears then that the conventional C-10 coating, applied at a thickness of 0.055 mils per side and without added tension, provided about one-half of the core loss reduction achievable under ideal tension conditions at 60 Hz and about one-third of that achievable at 400 Hz. With the C-10S coating, applied at a thickness of 0.051 mils and without added tension, about 80% of the available core-loss reduction was achieved at 60 Hz and about 72% was achieved at 400 Hz. The 1000 psi applied tension data on the coated samples serve to show how much of the possible core loss improvement was not actually achieved by the stresses from the coating. The coating thicknesses employed are substantially in the preferred range to provide a reasonable theoretical stacking factor of about 98%. Such core loss responses are noteworthy in view of the relatively low values of μ10 for the samples. Steels with higher μ10 levels resulting from sharper textures would be expected to respond even more favorably.

EXAMPLE 2

The same processing as used in Example 1 was applied to 4-mil thick steel in the same starting condition. The Epstein pack magnetic properties were as follows:

| Coating | μ10 (60 Hz) | 15 KG Core Loss* (Watts per Pound) 60 Hz | 400 Hz |
|---|---|---|---|
| Uncoated | 1790 | 0.712 | 6.828 |
| C-10 | 1741 | 0.608 | 6.275 |
| | | (−15) | (−8) |
| C-10S | 1749 | 0.603 | 6.173 |
| | | (−15) | (−10) |

*(Numbers in parentheses = % change from uncoated sample)

The C-10 coating reduced the 400 Hz loss by 8%, similar to the 7% achieved for the 6-mil steel in the Example 1. The C-10S coating provided a small additional improvement of about 2 percentage points at 400 Hz. Again, as in Example 1, selected strips were then subjected to single strip testing with and without mechanically applied tension and the results were as follows:

| Coating | Mechanically Applied Tension (psi) | Applied Coating Thickness (mils) | μ10 (60 Hz) | 15 KG Core Loss* (Watts per Pound) 60 Hz | 400 Hz |
|---|---|---|---|---|---|
| Uncoated | 0 | 0 | 1790 | 0.712 | 6.828 |
| Uncoated | 1000 | | 1800 | 0.519 | 5.554 |
| | | | | (−27) | (−19) |
| C-10 | 0 | 0.079 | 1741 | 0.608 | 6.275 |
| C-10 | 1000 | 0.079 | 1749 | 0.545 | 5.719 |
| | | | | (−10) | (−9) |
| C-10S | 0 | 0.067 | 1749 | 0.603 | 6.173 |
| C-10S | 1000 | 0.067 | 1756 | 0.540 | 5.626 |
| | | | | (−10) | (−9) |

*(Numbers in parentheses = % change from untensioned sample)

As with the 6-mil product of Example 1, the coatings were able to significantly reduce the core loss but not to the extent that mechanically applied uniaxial tension accomplishes on uncoated steel. The coatings were applied slightly thicker on the 4-mil steel than on the 6-mil steel which account for the sharper reduction in the μ10 levels, relative to the uncoated steel, than was observed for the 6-mil product. The fact that the C-10S coating was thinner than the C-10 coating in this case might explain why the C-10S coating did not notably outperform the C-10 coating. Some spalling of the C-10S coating was observed in the Example 2 sample which also detracted from its effectiveness.

EXAMPLE 3

The same processing as described in Example 1 was employed for some 2-mil thick steel in the same starting condition. The Epstein pack magnetic properties were as follows:

| Coating | μ10 (60 Hz) | 15 KG Core Loss* (Watts per Pound) 60 Hz | 400 Hz |
|---|---|---|---|
| Uncoated | 1830 | 0.718 | 6.493 |
| C-10 | 1775 | 0.558 | 5.676 |
| | | (−8) | (−13) |
| C-10S | 1784 | 0.705 | 6.022 |
| | | (−2) | (−7) |

*(Numbers in parentheses = % change from uncoated sample)

In this case the C-10 coating outperformed the C-10S coating. The likely reason for this discrepancy most probably lies in the extensive spalling of the C-10S coating on the 2-mil product. However, the 2-mil steel was still capable of responding to tension and selected strips were subjected to single strip testing with and without mechanically applied tension and the results were as follows:

| Coating | Mechanically Applied Tension (psi) | Applied Coating Thickness, mils | μ10 (60 Hz) | 15 KG Core Loss* (Watts per Pound) 60 Hz | 400 Hz |
|---|---|---|---|---|---|
| Uncoated | 0 | 0 | 1830 | 0.718 | 6.493 |
| Uncoated | 1000 | | 1837 | 0.636 | 5.879 |
| | | | | (−11) | (−9) |
| C-10 | 0 | 0.041 | 1775 | 0.658 | 5.676 |
| C-10 | 1000 | 0.041 | 1779 | 0.621 | 5.226 |
| | | | | (−6) | (−8) |
| C-10S | 0 | 0.033 | 1784 | 0.705 | 6.022 |
| C-10S | 1000 | 0.033 | 1790 | 0.639 | 5.505 |
| | | | | (−9) | (−9) |

*(Number in parentheses = % change untensioned sample)

By this experiment, it can be seen that the 2-mil product is capable of significant core loss reductions via tension, as shown by the uncoated steel; however, the extensive spalling of the C-10S coating and its lesser thickness, as with Example 2, produced results similar to those for the C-10 coating.

The spalling of stress coatings is not an unusual problem. Such coatings produce rather high stress levels (1000 psi) that can cause failure at the metal-coating interface. According to a further aspect of the present invention, the following method has been found to be highly successful in preparing the surface of light-gage (less than 7-mil and particularly less than 4-mil) grain-oriented silicon steels so as to produce a substrate surface that would support the stresses exerted by the C-10S (or similar) coating in order to prevent spalling thereof.

The subject steel samples were heated in air at 800° F. for 3 minutes. The steel was then treated with dilute phosphoric acid and then rinsed and dried. Thereafter the steel was subjected to another step of stress relief annealing in an inert atmosphere before coating. Particularly, the samples were stress relief annealed at 1550° F. in a nitrogen atmosphere for at least two hours. The stress relief anneal may range from 1300° to 1800° F. By "inert" it is meant that the atmosphere is not reactive with the steel material in the form being processed. The steel samples were then tested for their magnetic properties. Then they were coated with C-10 or C-10S, cured, and retested for their magnetic properties. Such a treatment virtually eliminated spalling of the coatings after curing. In the following Examples 4–6 this special surface treatment was used.

EXAMPLE 4

The aforementioned anti-spalling surface treatment and subsequent coating was performed on a group of four 6-mil Epstein packs. Similar to Examples 1–3, the steel of one of the packs was then left uncoated, a second was coated with the conventional C-10 coating, and the third and fourth were coated with two different thickness layers of the stress-inducing C-10S coating and the measured Epstein magnetic properties of the samples were as follows:

| Coating | Applied Coating Thickness (mils) | μ10 (60 Hz) | 15 KG Core Loss* (Watts per Pound) 60 Hz | 400 Hz |
|---|---|---|---|---|
| Uncoated | | 1774 | 0.606 | 6.978 |
| C-10 | 0.036 | 1767 | 0.585 | 6.906 |
| | | | (−3) | (−1) |
| Uncoated | | 1810 | 0.640 | 7.092 |
| C-10S | 0.025 | 1809 | 0.585 | 6.781 |
| | | | (−9) | (−4) |
| Uncoated | | 1785 | 0.620 | 7.027 |
| C-10S | 0.036 | 1785 | 0.552 | 6.670 |
| | | | (−11) | (−5) |

*(Numbers in parentheses = % change from uncoated sample)

These data indicate that the C-10S coating with its higher stress-inducing capability achieves a core loss benefit over the standard C-10 coating for the 6-mil product.

EXAMPLE 5

The same treatment was next tried on 4-mil steel with the following Epstein pack magnetic results:

| Coating | Applied Coating Thickness (mils) | μ10 (60 Hz) | 15 KG Core Loss* (Watts per Pound) 60 Hz | 400 Hz |
|---|---|---|---|---|
| Uncoated | | 1839 | 0.625 | 6.545 |
| C-10 | 0.046 | 1828 | 0.550 | 5.699 |
| | | | (−12) | (−13) |
| Uncoated | | 1841 | 0.613 | 6.437 |
| C-10S | 0.030 | 1842 | 0.492 | 5.224 |
| | | | (−20) | (−19) |
| Uncoated | | 1845 | 0.641 | 6.557 |
| C-10S | 0.048 | 1848 | 0.458 | 4.946 |
| | | | (−29) | (−25) |

*(Numbers in parentheses = % change from uncoated sample)

From this particular set of data it can be seen that with steels initially having a higher μ10 level, a significant core loss reduction is obtained from the C-10 coating, but a much more significant effect is obtained from the C-10S coating. The 0.048 mils of C-10S coating per side gives a theoretical stacking factor of 97.6%, and the core losses are very low.

EXAMPLE 6

The same treatment was applied to 2-mil steel with the following Epstein pack results:

| Coating | Applied Coating Thickness (mils) | μ10 (60 Hz) | 15 KG Core Loss* (Watts per Pound) 60 Hz | 400 Hz |
|---|---|---|---|---|
| Uncoated | | 1817 | 0.691 | 6.234 |
| C-10 | 0.050 | 1802 | 0.639 | 5.373 |
| | | | (−8) | (−14) |
| Uncoated | | 1803 | 0.737 | 6.500 |
| C-10S | 0.028 | 1805 | 0.658 | 5.351 |
| | | | (−11) | (−18) |
| Uncoated | | 1815 | 0.691 | 6.176 |
| C-10S | 0.061 | 1818 | 0.599 | 4.984 |
| | | | (−13) | (−19) |

*(Numbers in parentheses = % from uncoated sample)

This set of data illustrates that the stress coating can achieve substantial core loss reductions even when applied to extremely light-gage steels. The 0.061 mil coating thickness per side may be slightly too thick for this gage since it provides a theoretical stacking factor of 94.3%. However, the 0.028 mil coating per side materially lowered the core losses while projecting to a theoretical stacking factor of 97.3%.

The present invention thus presents a novel concept of stress coating light-gage (less than 7-mil) grain-oriented silicon steels to exert tensile stresses in such steels to materially reduce the core losses thereof at 60 Hz and higher frequencies, such as 400 Hz. It is believed that the benefits would continue to apply at higher test frequencies as well. As was clearly illustrated from the foregoing examples, significantly lower core losses are achieved in these steels when a stress-inducing coating is applied thereto when compared to the standard phosphate coatings that are commonly used as insulating coatings on oriented silicon steels of all gages. The present invention does not specify a particular stress coating formulation which must be used exclusively in order to carry out the operation of the invention. The only condition is that the coating must be capable of inducing rather large tensile stresses in the steel. The standard phosphate coating for example, exerts perhaps 400 to 600 psi of tensile stress; however, any coating formulation that can induce tensile stresses in excess of 600 psi, preferably about 1000 psi, should provide to some degree the benefit described by this invention.

Still further, the present invention has further provided a novel anti-spalling method for treating the surfaces of the steel which receive the stress coatings so as to provide a suitable substrate for supporting the large tension stresses exerted by the coatings.

While the present invention has been described in accordance with the preferred embodiment, it is to be understood that other similar embodiments may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

We claim:

1. A method for reducing the core losses in light-gage grain-oriented silicon electrical steel of less than 7-mil thickness and having a μ10 value no greater than 1850 at an operating frequency of at least 60 Hz, said method comprising:

preparing said steel surface by heating the steel in an oxidizing atmosphere at about 800° F. but no more than 1475° F., removing any surface oxides, and then stress relief annealing the steel in an inert atmosphere; thereafter coating said steel with stress coating capable of inducing at least a 600 psi tensile stress in said steel; and curing said coating on said steel to impart the stress, said preparation produces a steel surface which will support the stresses exerted by the stress coating without spalling of the coating.

2. The method of claim 1 wherein said operating frequency is at least 400 Hz.

3. The method of claim 1 wherein the tensile stress induced by said stress-inducing coating is at least 1000 psi.

4. The method of claim 1 wherein said stress relief annealing is performed in an inert atmosphere at temperatures of 1300° to 1800° F. for a time sufficient to relieve stresses.

5. The method of claim 4 wherein said stress relief annealing is performed in nitrogen at about 1550° F. for at least two hours.

6. The method of claim 1 further comprising:

heating the steel in air at 800° F. to 1475° F.;

treating the steel with dilute acid;

rinsing and drying the steel; and stress relief annealing the steel in an inert atmosphere at 1300° to 1800° F.

* * * * *